US005542484A

United States Patent [19]

McInnes

[11] Patent Number: 5,542,484

[45] Date of Patent: Aug. 6, 1996

[54] LIQUID RECIPROCATING PISTON HAMMER DRILLING ARRANGEMENT WITHOUT CAVITATION

[75] Inventor: Malcolm B. McInnes, Angle Vale, Australia

[73] Assignee: SDS PTY, Ltd., Melrose Park, Australia

[21] Appl. No.: 335,878

[22] PCT Filed: May 12, 1993

[86] PCT No.: PCT/AU93/00217

§ 371 Date: Dec. 27, 1994

§ 102(e) Date: Dec. 27, 1994

[87] PCT Pub. No.: WO93/23651

PCT Pub. Date: Nov. 25, 1993

[30] Foreign Application Priority Data

May 15, 1992 [AU] Australia ..... PL2482

[51] Int. Cl.[6] ..... E21B 7/04; E21B 4/14

[52] U.S. Cl. ..... 175/296; 173/73

[58] Field of Search ..... 175/296, 215, 175/320; 173/62, 73, 78

[56] References Cited

U.S. PATENT DOCUMENTS

| | | | |
|---|---|---|---|
| 1,940,846 | 12/1933 | Curtis | 173/78 |
| 2,786,451 | 3/1957 | Dulaney | 173/73 |
| 2,837,317 | 6/1958 | Hulshizer | 175/296 |
| 2,859,733 | 11/1958 | Bassinger et al. | 173/73 |
| 2,942,578 | 6/1960 | Huffman et al. | 175/296 |
| 3,051,134 | 8/1962 | Lincoln | 173/78 |
| 3,101,796 | 8/1963 | Stall et al. | 173/73 |
| 3,403,739 | 10/1968 | Brown | 173/73 |
| 3,552,500 | 1/1971 | Peterson | 175/296 X |
| 4,402,370 | 9/1983 | Gein et al. | 173/73 |
| 5,305,837 | 4/1994 | Johns et al. | 175/296 X |

FOREIGN PATENT DOCUMENTS 1361284 12/1987 U.S.S.R. .

*Primary Examiner*—Frank Tsay
*Attorney, Agent, or Firm*—Michael N. Meller

[57] ABSTRACT

A drilling arrangement is provided having a reciprocating piston hammer which hammers a drill bit for hydraulic down-the-hole piston hammer drilling. The drilling arrangement uses a liquid for driving the reciprocating piston hammer with respective impacting facing surfaces between the hammer and the drill. The respective impacting facing surfaces are formed such that at the moment of impact some of the liquid is forced between the impacting surfaces. This substantially reduces if not eliminating altogether the cavitation which might otherwise develop.

14 Claims, 2 Drawing Sheets

LIQUID RECIPROCATING PISTON HAMMER DRILLING ARRANGEMENT WITHOUT CAVITATION

This invention relates to a drilling arrangement wherein there is included a reciprocating piston hammer effecting a hammering against a drill bit.

BACKGROUND OF THE INVENTION

The invention has particular application to a hydraulic down-the-hole piston hammer assembly directly acting against a drill bit which in turn is mechanically rotated and which is adapted to use the hydraulic fluid to. recover at least in part cuttings resulting from the actions.

The problem to which this invention is directed relates to the situation where the reciprocating piston hammer is driven by a fluid at pressure and the impacting faces between the hammer and the drill bit are within the fluid.

Conventionally the fluid is water.

The problem is that where the hammer is caused to strike a first end of the drill bit, upon removal of the striking face of the hammer, there will be caused, in view of the rapidity of the action, some cavitation which in turn will cause, upon collapsing of voids, significant stress forces in the localised vicinity of the impacting faces.

Such an effect has the capacity to effect significant and relatively rapid removal of parts of the material of the impacting surfaces.

BRIEF DESCRIPTION OF THE DRAWINGS

An object of this invention is to provide an arrangement which has the ability to reduce this problem.

According to this invention there is a drilling arrangement of a type using fluid for driving a reciprocating piston hammer, with respective impacting surfaces between the hammer and the drill characterised in that at least one of the surfaces includes at least one channel.

In preference but not essentially, the surface opposite the surface containing the channel, includes a protrusion located so as to be coincident with the location of the channel.

In preference but not essentially, the channel is located in the surface of the first end of the drill bit so as to define therebetween two annular faces and the piston hammer has a correspondingly located outer surface with a correspondingly located circular protrusion located so as to be located when the two impacting surfaces are together, in the channel shape.

In preference but not essentially, the surfaces impacting one against the other are planar across their impacting faces except for the channel and protuberant shapes and the orientation of the respective planar surfaces is at right angles to the direction of relative movement between the two parts.

It is thought that the effectiveness of this described feature arises from the factor that as the faces are impacted together, there is some trapped fluid within the channel shape which as it is caused to be compressed, will cause some fluid to escape past the surfaces coming together and that such action will significantly retard the force of the piston hammer as it approaches the surface of the bit to the extent that most of the impact will be effected through the medium of the fluid acting as an interface between the respective surfaces.

The part of the piston hammer protruding has the effect of additionally forcing fluid at the last moment at a more rapid rate through the closing gap to assist this effect.

In preference, but not essential, the fluid is water.

Ideally, the actual surfaces do not contact directly so that when the surfaces are then drawn away, there is a film of fluid already existing so that the restoration of fluid behind the retreating surface is effected with much less negative pressure and minimal cavitation.

For a better understanding of this invention it will now be described with reference to an embodiment it being emphasised that this is illustrative and not intended to be a limiting explanation of any aspect of the invention.

Figure 1:
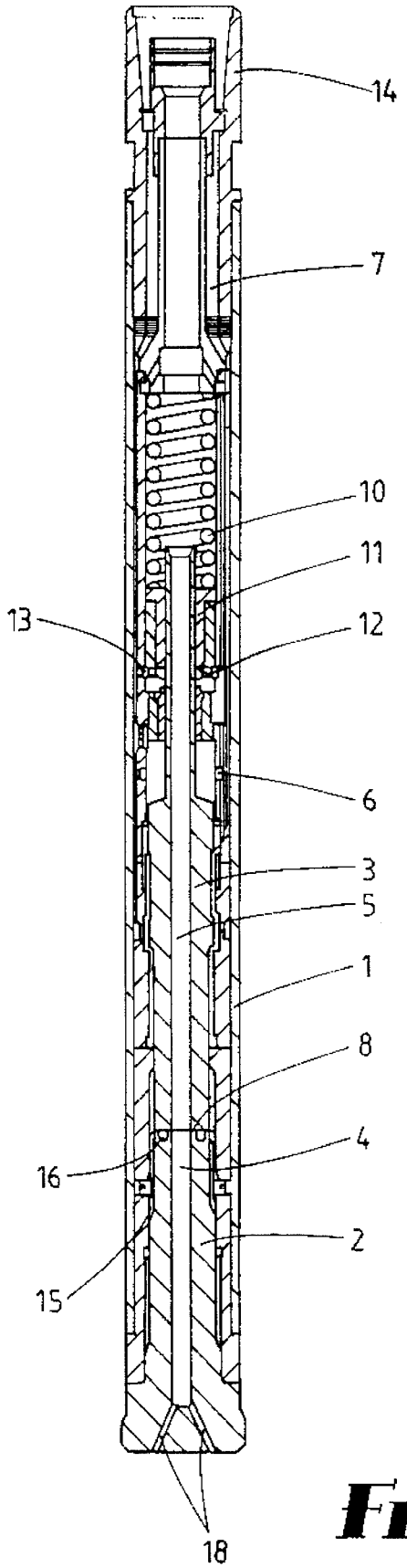
Figure 2:
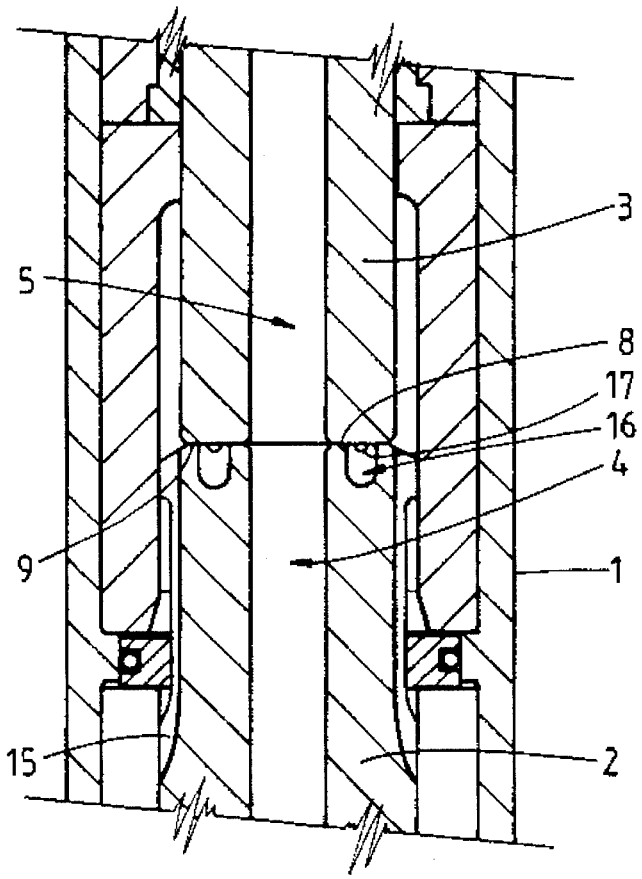
Figure 3:
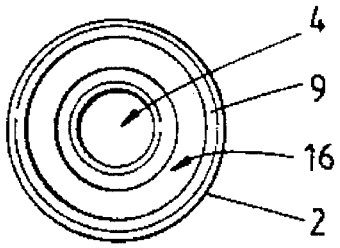
Figure 4:
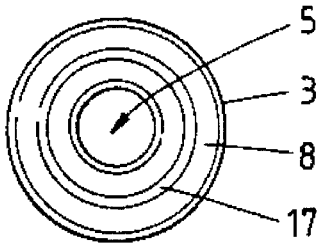

Accordingly, the embodiment will be described with the assistance of drawings in which:

FIG. 1 is a cross sectional view of an assembly including a reciprocating piston hammer and a drill bit, FIG. 2 is an enlargement of a part of the view in FIG. 1, FIG. 3 is a plan view of the impact surface of the inner side of the drill bit, and FIG. 4 is a plan view of the impact surface of the impacting piston.

DESCRIPTION OF THE PREFERRED EMBODIMENTS

Referring in detail to the drawings the down-the-hole assembly 1 includes a drill bit 2 and an impacting piston 3.

The drill bit 2 and the piston 3 each have a central channel shown respectively at 4 and 5 providing a return path for the fluid which in this case is an aqueous fluid.

Other features within the assembly include an appropriate valving arrangement shown typically at 6 and elsewhere such that fluid at pressure coming through an annular channel 7 will cause the piston 3 to reciprocate and thereby effect a repetitive hammering against the lowermost face shown at 8 which in turn hits the inner surface 9 of the piston 3. Remaining features within this description include a pressure relief system including a helical spring 10 controlling piston 11 which has a lower surface at 12 connected through channel 13 to the high pressure side of the fluid.

The system and assembly as a whole is intended to work down-the-hole and is thereby supported by an appropriate stem assembly not shown which is connected at the upper end shown at 14.

In this arrangement, some of the fluid at pressure is used to cause the piston 3 to reciprocate, and the remainder is directed through channels 15 in such a way that the fluid is caused to pass around the outside of the drill bit head and return through the return passages 18 in the head.

The problem however to which this description is specifically directed relates to the impacting surfaces between the piston 3 and the inner surface of the drill bit 2 which is illustrated at 9.

The respective surfaces are substantially of annular shape and have substantially coincident external and internal diameters and surfaces that impact against each other or are intended to be closest at impact, recalling that it is expected that the aqueous fluid will stay to some extent between the two surfaces, are in each case planar and are aligned in their planar orientation so that they are at right angles to the cylindrical central axis of the piston which in turn defines the reciprocating direction.

The problem is of course that when the piston 3 impacts against the drill bit 2, there will be the two surfaces which having been impacted together with substantial and repetitive forces so that these will be closely aligned in shape and would therefore be normally expected to have excluded effectively any fluid.

As soon as the piston then is caused to return for the next cyclic impact, it has to break apart the respective surfaces and because this will have to be done very quickly, it is expected that this will conventionally pull a momentary vacuum in the sense of cavitation which will thereafter collapse causing effective momentary very high forces within the very localised vicinity transmitted through the fluid.

In order to minimise this, there is accordingly located an annular channel 16 which is located substantially midway between the inner and outer circular peripheries of the piston 2 and which is of constant cross sectional shape and size throughout its path with its path being coaxial with respect to the axis of the drill bit. The channel being a depression within an otherwise planar face.

Further, located on the other side namely the impacting surface of the piston 3 there is a downwardly protruding annular protuberance 17 the location of which is coincident with the medial alignment of the channel 16 the protuberance being of a constant cross sectional shape and size throughout its path with its path being coaxial with respect to the axis of the drill bit. The protuberance extending out from an otherwise planar face.

The drawings 1 and 2 illustrate the presence, size and shape of these cooperating shapes.

The invention however, is not intended to be limited necessarily to this very specific illustration.

However, with this particular illustration, by trapping some water within one of the faces which will normally be the surface which is upwardly facing so that the channels have an uppermost opening so that these will naturally retain the aqueous fluid therein, is such that as the piston 3 presses down on the surface 9, the trapped aqueous fluid within the channel 16 will be slightly compressed. This effect will be slightly magnified by reason of the protuberance 17 with the result that there will be increased squeezing pressure of the fluid to escape. Insofar that the time allowed for this is very small, considering the viscosity of the fluid, there will be some liquid remaining between the respective surfaces.

With such remaining fluid, the result is that as the piston 3 retracts, the effect will not be so severe in terms of cavitation because of the thin film of water still remaining between the respective surfaces and hence a reduction of potential material removal between the impacting surfaces from this effect.

Alternative arrangements including a plurality of channels and an inclusion of an external skirt so as to provide some retardation of exuding water are considered to perhaps assist the action but are not the preferred techniques presently being used.

The use of the coaxial channel and protuberance allows for relative rotational orientation of one of the elements as compared to the other.

Using the invention as described has resulted in significantly reduced cavitational corrosion in the application to the extent that there has been negligible corrosion observed in test examples thus far trialed.

I claim:

1. A drilling arrangement having a reciprocating piston hammer adapted to hammer against a drill bit of a type using a liquid for driving said reciprocating piston hammer, with respective impacting surfaces between said hammer and said drill bit, said drill bit having a channel following a circular path which is coaxial with the central axis of said drill bit, said hammer having a protuberance extending from said impacting surface of said hammer, the protuberance following a circular path which is coaxial with the central axis of the drill bit and of a width and positioned such that the protuberance will be fully within the channel in the drill bit when the respective impacting surfaces are at their relative impacting positions.

2. A drilling arrangement as in claim 1 wherein said impacting surfaces are planar across their impacting faces except for said channel and said protuberance and the respective planar impacting surfaces are at right angles to the direction of relative movement between said hammer and said drill bit.

3. A drilling arrangement as in claim 2 in which the liquid is water.

4. A drilling arrangement as in claim 1 in which the liquid is water.

5. A drilling arrangement having a reciprocating piston hammer adapted to hammer against a drill bit of a type using a liquid for driving said reciprocating piston hammer, with respective impacting facing surfaces between said hammer and said drill bit, a portion of one of said facing surfaces having a protuberance which extends into a channel in the other of said facing surfaces when said piston hammer is hammered against said drill bit, said other facing surface holding said liquid in a constrained manner whereby some of said liquid in said channel is displaced by said protuberance extending into said channel.

6. A drilling arrangement as in claim 5 wherein said drill bit has a central axis, said channel in said other facing surface is of constant cross sectional shape and size and is coaxial with said central axis of said drill bit.

7. A drilling arrangement as in claim 6 in which said channel is a depression within an otherwise planar surface.

8. A drilling arrangement as in claim 7 wherein said protuberance is of a constant cross sectional shape and size and is coaxial with the axis of the drill bit and said protuberance extending out from an otherwise planar surface.

9. A drilling arrangement as in claim 8, wherein said impacting facing surfaces are planar across their impacting faces except for said channel and said protuberance and the respective planar impacting facing surfaces are at right angles to the direction of the relative movement between said hammer and said drill bit.

10. A drilling arrangement as in claim 8 in which the liquid is water.

11. A drilling arrangement as in claim 6, wherein said impacting facing surfaces are planar across their impacting faces except for said channel and said protuberance and the respective planar impacting facing surfaces are at right angles to the direction of the relative movement between said hammer and said drill bit.

12. A drilling arrangement as in claim 7, wherein said impacting facing surfaces are planar across their impacting faces except for said channel and said protuberance and the respective planar impacting facing surfaces are at right angles to the direction of the relative movement between said hammer and said drill bit.

13. A drilling arrangement as in claim 7 in which the liquid is water.

14. A drilling arrangement as in claim 5, wherein said impacting facing surfaces are planar across their impacting faces except for said channel and said protuberance and the respective planar impacting facing surfaces are at right angles to the direction of the relative movement between said hammer and said drill bit.

* * * * *